US011608981B1

(12) United States Patent
Grusha

(10) Patent No.: US 11,608,981 B1
(45) Date of Patent: Mar. 21, 2023

(54) NOZZLE FOR FEEDING COMBUSTION MEDIA INTO A FURNACE

(71) Applicant: R-V Industries, Inc., Honey Brook, PA (US)

(72) Inventor: John Grusha, Shoemakersville, PA (US)

(73) Assignee: R-V Industries, Inc., Honey Brook, PA (US)

( * ) Notice: Subject to any disclaimer, the term of this patent is extended or adjusted under 35 U.S.C. 154(b) by 67 days.

(21) Appl. No.: 17/462,838

(22) Filed: Aug. 31, 2021

(51) Int. Cl.
*F23D 1/00* (2006.01)

(52) U.S. Cl.
CPC ..... *F23D 1/00* (2013.01); *F23D 2201/10* (2013.01); *F23D 2201/20* (2013.01)

(58) Field of Classification Search
CPC ..... F23D 1/00
See application file for complete search history.

(56) References Cited

U.S. PATENT DOCUMENTS 4,252,069 A 2/1981 McCartney
4,356,975 A * 11/1982 Chadshay ..... F23D 1/00 239/590.5
4,634,054 A 1/1987 Grusha
5,483,906 A 1/1996 Hufton
8,413,595 B2 4/2013 Grusha
2009/0277364 A1* 11/2009 Donais ..... F23D 1/00 110/263
2010/0064986 A1* 3/2010 Kiyama ..... F22B 21/26 431/190

OTHER PUBLICATIONS

R-V Industries, Inc. "R-V's Stiffener Bars Reduce Splitter Plate Distortions," Jul. 14, 2021, one page advertisement published in the United States by R-V Industries, Inc.
R-V Industries, Inc. "Tip, Adjustable TG Series II Coal Nozzle Tip," Aug. 16, 2018, one sheet of drawing, No. 62-41022, published in the United States by R-V Industries, Inc.

* cited by examiner

*Primary Examiner* — Nathaniel Herzfeld
(74) *Attorney, Agent, or Firm* — Howson & Howson LLP

(57) ABSTRACT

In a nozzle for feeding a combustible medium such as coal particles along with air into a furnace, the exit end of each splitter plate in the nozzle is reinforced by a stiffener having an external cross-sectional shape in the form of a continuous curve proceeding outward and forward from a first surface of the plate to a first location, inward from the first location to a second location beyond the level of an opposite second surface of the plate, and inward and rearward from the second location to the second surface. The stiffener can be hollow, and can also be provided with openings for the flow of cooling air from the interior to the exterior of the stiffener. The continuous curvature of the exterior of the stiffener avoids recirculating flow at locations adjacent the stiffener and thereby minimizes flame attachment and deposition of ash or fuel sediment onto the reinforced splitter plates.

8 Claims, 2 Drawing Sheets

NOZZLE FOR FEEDING COMBUSTION MEDIA INTO A FURNACE

FIELD OF THE INVENTION

This invention relates to nozzles for feeding combustion media, for example pulverized coal and air, into a furnace. The invention has particular application in nozzles for feeding flowable combustion media into tangentially fired burners of steam generating boilers. Such flowable combustion media may include, for example, pulverized coal entrained in air, other solid fuels such as biomass or refuse-derived fuels, also entrained in air, gaseous fuels, and also air by itself, for example secondary air directed into a furnace to support combustion.

BACKGROUND OF THE INVENTION

Many solid fuel and coal-fired power plant boilers are designed for tangential firing, i.e., a configuration in which streams of pulverized coal or other solid fuels, along with air, are directed into a rectangular furnace compartment from columns of nozzles located in such a way as to generate a slowly rotating cyclonic fireball, which produces heat. The heat generated by the combustion of fuel boils water in arrays of water tubes lining the walls of the compartment. Tangential firing is described in a number of patents including U.S. Pat. Nos. 4,252,069, 4,634,054, 5,483,906 and 8,413,595.

The columns of nozzles include nozzle tips which protrude into the furnace, and the nozzle tips are typically pivotable about horizontal axes so that the direction of the air and fuel discharged from the nozzle tips can be adjusted to control the position of the fireball.

These nozzle tips commonly have a double shell configuration, comprising an outer shell, and an inner shell coaxially disposed within the outer shell to provide an annular space between the inner and outer shells. The inner shell is connected to a fuel feeding conduit for feeding pulverized coal or other solid fuel, entrained in air flowing through the inner shell, into the furnace. The annular space between the inner and outer shells is connected to a secondary air conduit for feeding secondary air into the furnace. The secondary air not only serves as supplemental combustion air, but also cools the inner and outer shells. The fuel feeding pipe is typically disposed coaxially within in the secondary air conduit. In furnaces fueled by biomass and other solid fuels such as refuse-derived fuels, the fuel nozzles are similar to these coal nozzles.

A furnace will typically have not only several coal nozzle tips at each corner of the rectangular furnace compartment, but also several air nozzle tips, arranged in a column along with the coal nozzle tips, to introduce additional secondary air into the furnace.

The inner shell of the nozzle tip includes splitter plates which divide the interior of the inner shell into plural flow passages for the flow of coal particles, or other solid fuel particles, along with air. The splitter plates control the direction of the stream of coal and air being discharged through the inner shell of the nozzle tip to ensure a uniform distribution of the stream of coal and air, particularly when the nozzle tip is tilted upward or downward.

These nozzle tips are exposed to high temperatures due both to radiation from the fireball and to hot gases circulating in the furnace. In addition, they are exposed to coal particles, and, especially in the case of high-sulfur coal, they are exposed to ash, composed primarily of iron oxide particles which tend to adhere to parts of the nozzle tips and particularly to the exit edges of the splitter plates. Due to continuous exposure to very high temperatures and to the deposition of coal and ash, metallurgical creep occurs and results in distortion of the splitter plates and other parts of the nozzles. Continued distortion eventually causes metal and weld failures, which affect the aerodynamics at the nozzle outlet, lead to more ash deposition, plugging of the nozzle tip outlet area, and premature structural and configurational failure of the nozzle.

Distortion of the splitter plates has been addressed in the past by welding stiffener bars to the exit edges of the splitter plates. The stiffener bars strengthen the plates, shield them from direct radiation, reduce distortion, and prolong the useful life of a nozzle. However, the mixture of coal and air tends to recirculate into low pressure zones as it passes over the stiffener bars, and, especially in the case where high sulfur coal is being utilized, this recirculation can cause flame attachment, and can also cause ash to adhere to the stiffener bars and adjacent parts of the splitter plates. The adhering ash then becomes a heat sink that causes the associated metal parts to overheat, weaken and become distorted.

SUMMARY OF THE INVENTION

The primary object of this invention is to strengthen the furnace ends of nozzle tips, to shield them from hot furnace gases and radiation, and to extend their service life. Briefly, the invention resides in a reinforcing stiffener at the exit edge of a splitter plate in a coal nozzle, shaped so that the aerodynamic flow of air and entrained coal particles past the exit edge of the splitter plates exhibits reduced recirculation, and thereby avoids flame attachment and significant accumulation of coal ash on the exit ends of the splitter plates.

The preferred stiffener is in the form of a smoothly curved cylinder secured to, and extending along, the exit edge of a splitter plate. The cylinder may be solid. Alternatively, it may be hollow, and, if hollow, it can be provided with openings at one or both of its ends to receive air, and obliquely directed exit openings for the flow of air from the interior of the tube to the exterior thereof for cooling and improved high temperature creep resistance.

The aerodynamic feature is of primary advantage when firing high sulfur coals (i.e. coals containing more than 1% sulfur) to prevent or reduce coal ash (iron oxide) adhesion onto exposed splitter plate surfaces. Splitter plates with the cylindrical reinforcement can also be used with lower sulfur coals and other fuels, and in nozzles for introducing other combustion media. The cylindrical reinforcement is applicable not only to nozzles with horizontal splitter plates, but also to nozzles with vertical splitter plates.

More particularly, the invention is a nozzle for feeding a flowable combustion medium i.e., a combustible medium such as particles of coal or biomass, entrained in air (usually referred to as "primary air"), or air alone (usually referred to as "secondary air," into a furnace.

The nozzle comprises a nozzle tip for directing flow of the combustion medium into the combustion chamber of a furnace. The nozzle tip includes a shell having an inlet for receiving the combustion medium, an outlet for directing the combustion medium into the combustion chamber, and an interior space located between the inlet and the outlet.

The nozzle further comprises a splitter located within the shell. The splitter comprises one or more splitter plates, each extending in a forward direction, i.e., away from the inlet and toward said outlet. The splitter plates divide the interior space of the shell into two or more channels, each allowing for the flow of part of the combustion medium from the inlet to the outlet.

Each splitter plate has a planar first surface, an opposite planar second surface, and a downstream edge extending across the shell adjacent the outlet of the shell.

The nozzle further comprises a stiffener extending along the downstream edge of each splitter plate. The external cross-section of each stiffener, transverse to the direction in which the stiffener extends along the downstream edge of its splitter plate, is in the form of a continuous curve proceeding outward and forward from the first surface to a first location, inward from the first location to a second location beyond the plane of the second surface of the splitter plate, and inward and rearward from the second location to the second surface of the splitter plate. The shape of the stiffener exerts an aerodynamic effect which results in a reduction of recirculation of the combustion medium flowing past the stiffener, reduces deposition of ash. The aerodynamic effect significantly extends the useful life of the nozzle.

The external cross-section of the stiffener has a cylindrical shape, i.e., the cross sections throughout most of its length are uniform. The part of the external cross-section of the stiffener that proceeds from the first location to the second location should be convex and preferably, the cross-sectional shape of the stiffener is circular or elliptical, except at the locations of welds that secure the stiffener to the exit edge of the splitter plate.

The stiffener can have a hollow interior, openings at one of both of its ends for receiving secondary air from one or more channels in the nozzle tip, and plural openings distributed along the length of the stiffener for releasing the secondary air from the interior of the stiffener for the purpose of cooling. These plural openings preferably extend from the hollow interior to the exterior of stiffener in two groups. A first group is positioned to direct air from the interior of the stiffener to the exterior thereof in a direction forward and outward from the first surface of the splitter plate, and a second group of is positioned to direct air from the interior of the stiffener to the exterior thereof in direction forward and outward from the second surface.

The aerodynamic effect of the improved stiffener in accordance with the invention, along with its reinforcement of the splitter plates, results in a significant reduction in thermal distortion and warping, and extend the useful life of the nozzle. When the stiffener is hollow, and provided with openings for the flow of cooling air outward from its interior into the path of flow of the combustion medium, still further improvements in the useful life of the nozzle can be achieved.

DETAILED DESCRIPTION OF THE PREFERRED EMBODIMENTS

Figure 1:
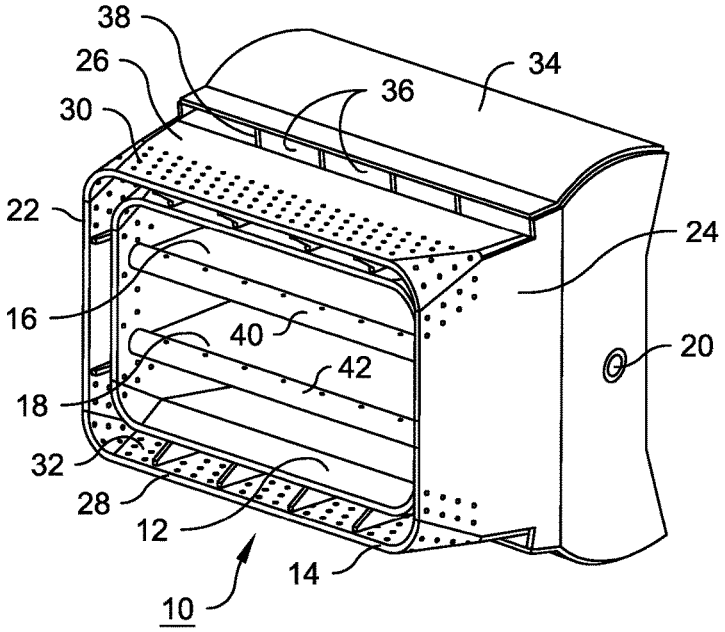
FIG. 1 is an oblique perspective view of a nozzle tip in accordance with the invention.

The nozzle tip 10 in FIG. 1 is a vertically tilting nozzle tip, composed of an inner shell 12 surrounded by an outer shell 14. Horizontal splitter plates 16 and 18 divide the interior of the inner shell into three flow passages for flow of combustion media, typically pulverized coal particles entrained in a stream of primary air. Secondary air flows through a space between the inner and outer shells. The nozzle tip is mounted on trunnions, one of which is shown at 20, for tilting about a horizontal axis.

The outer shell is typically, but not necessarily, tapered, and is composed of two vertical side walls 22 and 24, and upper and lower walls 26 and 28, respectively.

An array 30 of holes is provided in the upper wall 26 of the nozzle tip, and a similar array 32 of holes is provided in the lower wall 28. The arrays are located adjacent the front opening of the outer shell and extend rearward to an intermediate location between the front and rear openings of the outer shell. The holes in these arrays allow flow of secondary air from the space between the inner and outer shells, through the outer shell, to the outer surface of the outer shell. Air passes through the holes from the interior of the nozzle tip to the exterior, reducing the temperature difference between the inner and outer surfaces, thereby reducing thermal distortion and resulting damage. When the nozzle is tilted, the flow of air through the holes in the wall facing the flame increases so that a greater cooling effect is achieved at the parts of the nozzle tip having the greater exposure to radiant heat. The flow of air through the arrays of holes washes the exposed outer surface of the nozzle tip with cool air in a film or boundary layer. The air flow also reduces direct contact between the flame and the nozzle tip. Details of the arrays of holes and their function are explained in U.S. Pat. No. 8,413,595, granted on Apr. 9, 2013. The disclosure of U.S. Pat. No. 8,413,595 is here incorporated by reference.

The nozzle tip includes an outer shroud 34 forming channels 36, bounded by the outer shroud, the upper wall 26 of the nozzle tip, and shroud-supporting partitions 38. A similar shroud structure is provided on the bottom side of the nozzle tip. The channels 36 direct secondary air along the outer surface of the upper wall 26 of the nozzle tip, and similar channels (not shown) direct air along the outer surface of the lower wall 28. Cooling is achieved by flow of air though the arrays of holes and by the flow of secondary air flow through the shrouds.

The upper and lower shrouds are convex so that the gap between the nozzle tip and the nozzle (not shown) in which it fits remains substantially the same regardless of the angle of tilt.

Figure 2:
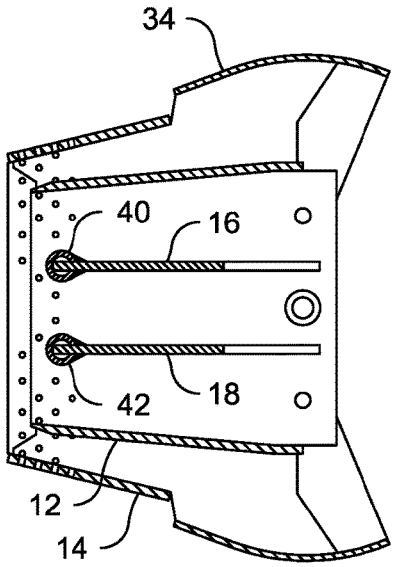
FIG. 2 is a vertical cross-sectional view of the nozzle.
Figure 5:
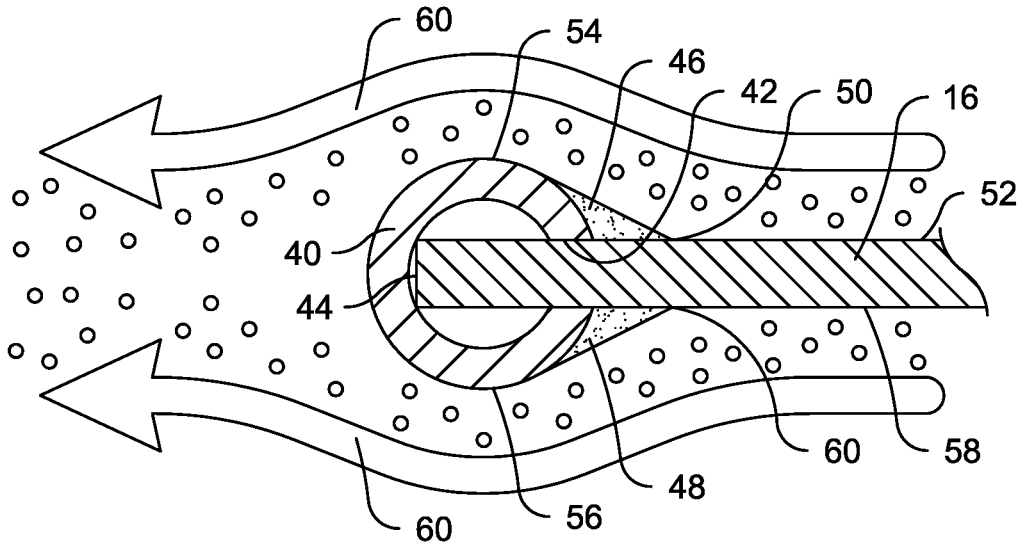
FIG. 5 is a schematic view illustrating the flow of air and combustion medium past a stiffener disposed on the downstream end of a splitter plate.

As shown in FIGS. 1 and 2, stiffeners 40 and 42 are secured at the downstream edges of the splitter plates 16 and 18 respectively, each preferably extending along the full length of the splitter plate from one side wall to the opposite side wall of the inner shell 12. As shown in FIG. 5, stiffener 40, which extends along the downstream edge of splitter plate 16 is in the form of a circular cylindrical tube having a longitudinal slot 42, which receives a portion of the splitter plate including the downstream edge 44, which is situated inside the tube. Welds 46 and 48 secure the tube to the splitter plate. The welds constitute parts of the stiffener, and the outer surfaces of the welds define parts of the external cross-sectional shape of the stiffener.

As will be apparent from FIG. 5, the external cross-sectional shape of the stiffener is in the form of a continuous curve proceeding from a location 50 where the outer surface of weld 46 meets a first surface (the upper surface) 52 of plate 16, outward and forward from surface 52 to a first location 54, then inward from location 54 toward a second location 56 beyond the plane of a second surface 58 (the lower surface) of plate 16, and then inward and rearward from the second location 56 to a location 60 on the second surface 58 of the plate. Preferably the curvature of the exterior of the stiffener is convex except at the locations of the exterior portions of the welds, which can be straight or slightly concave.

Arrows 60 in FIG. 5 show the direction of flow of the combustible medium, composed of coal particles entrained in air, in the region adjacent the stiffener 40. The continuous curvature, i.e., the absence of sharp transitions in the direction of the curvature of the external cross-section of the stiffener, minimizes recirculating flow, and reduces the amount of ash deposited on the stiffener and other parts of the exit portion of the splitter plate 16.

Figure 3:
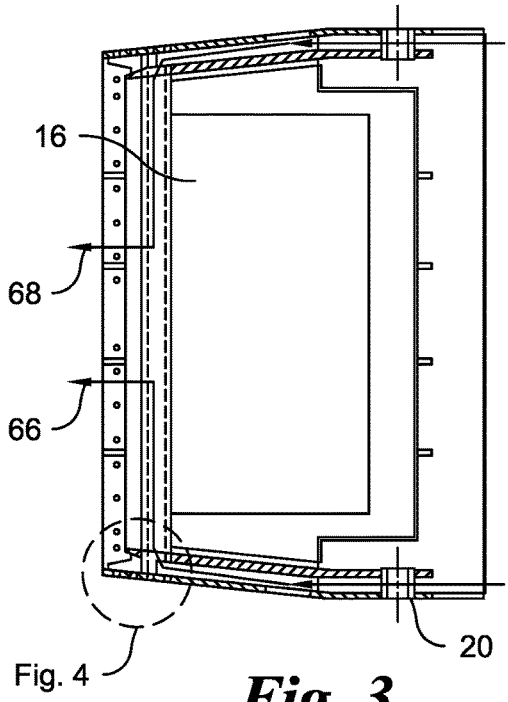
FIG. 3 is a horizontal cross-sectional view of the nozzle, with arrows showing the path of air flow through a hollow stiffener.
Figure 4:
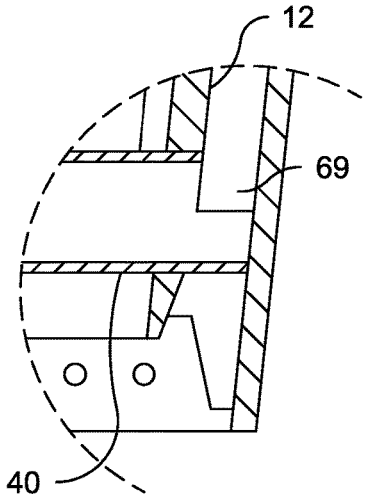
FIG. 4 is an enlarged view showing details of an opening for entry of air into the hollow stiffener in the nozzle of FIG. 3.
Figure 6:
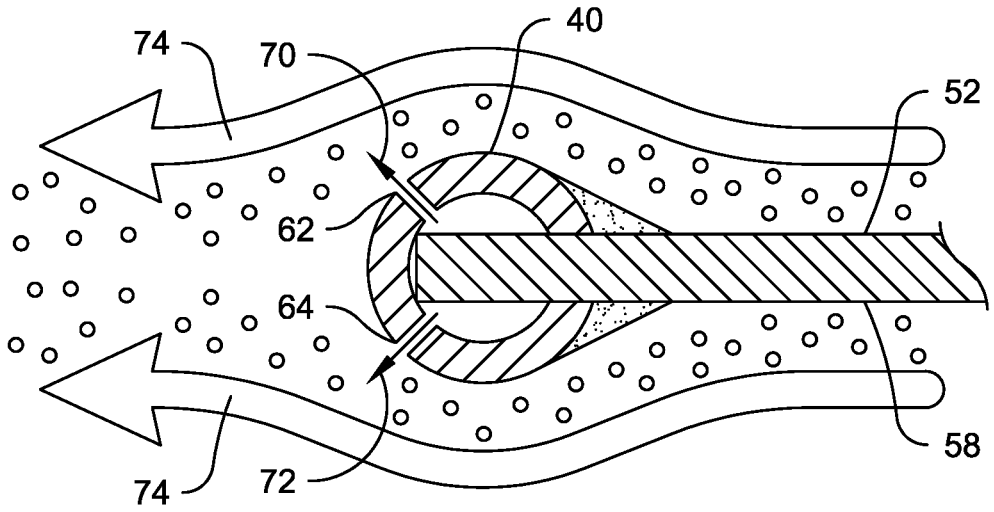
FIG. 6 is a schematic view illustrating the flow of air and combustion medium past a stiffener disposed on the downstream end of a splitter plate and also illustrating he flow of air from the interior of the stiffener through air holes formed in the stiffener.

As shown in FIG. 1, stiffener 40 is formed with an array of openings that allow air to flow from the interior of the stiffener to the exterior. FIG. 6 is a schematic cross-sectional view taken on a section plane that intersects two of the openings. An upper opening 62 is positioned to direct air from the interior of stiffener 40 to the exterior thereof in a direction forward and outward from surface 52. A lower opening 64 is positioned to direct air from the interior of stiffener 40 to the exterior thereof in a direction forward and downward from surface 58. The other openings in the stiffener are similarly situated. Arrows 66 and 68 in FIG. 3 depict the flow of air, which enters the hollow stiffener through both ends from a space between the inner and outer shells. As shown in FIG. 4, hollow stiffener 40 extends though a side wall of the inner shell 12 and is formed with a rearward-facing opening 69 constituted by a cut-away portion of the part of the stiffener 4 that extends outward beyond the side wall of the inner shell. A similar opening is provided at the opposite end of the stiffener. Air flowing between the inner and outer shells enters the stiffener through these openings and exits through the upper and lower outlet openings in the directions illustrated by arrows 70 and 72 in FIG. 6. The flow of air though the outlet openings has a cooling effect, but little, if any effect on the flow of the combustible medium in the vicinity of the stiffener, which is illustrated by arrows 74.

In summary, the continuous curvature of the exteriors of the stiffeners in cross-section allows the stiffeners to strengthen the exits end of the splitter plates without creating conditions that promote ash adhesion, and the flow of air from the interior of the stiffeners through their openings promotes cooling and reduces high temperature creep.

What is claimed is:

1. A nozzle for feeding a flowable combustion medium into a furnace having a combustion chamber, the nozzle comprising:

a nozzle tip for directing flow of said combustion medium into said combustion chamber, said nozzle tip including a shell having an inlet for receiving said combustion medium, an outlet for directing said combustion medium into said combustion chamber, and an interior space located between said inlet and said outlet;

a splitter located within said shell, the splitter comprising at least one splitter plate extending in a forward direction, away from said inlet and toward said outlet, and dividing said interior space of said shell into at least two channels, each allowing for the flow of part of said combustion medium from said inlet to said outlet;

wherein said at least one splitter plate has a planar first surface, an opposite planar second surface, and a downstream edge extending across said shell adjacent the outlet thereof; and wherein said nozzle further comprises a stiffener extending along said downstream edge of said at least one splitter plate, the external cross-section of said stiffener, transverse to the direction in which the stiffener extends along said downstream edge, being in the form of a continuous curve proceeding outward and forward from said first surface to a first location, inward from said first location to a second location beyond the plane of said second surface, and inward and rearward from said second location to said second surface;

whereby the downstream edge of said at least one splitter plate is stiffened, but recirculation of said combustion medium flowing past said stiffener is minimized.

2. The nozzle according to claim 1, in which the external cross-section of said stiffener has a cylindrical shape.

3. The nozzle according to claim 1, in which at least the part of the external cross-section of said stiffener that proceeds from said first location to said second location is convex.

4. The nozzle according to claim 1, in which said stiffener has a hollow interior, an opening at least at one of its ends for receiving air from a channel in said nozzle tip, and plural openings distributed along the length of said stiffener, said plural openings extending from said hollow interior to the exterior of said stiffener, a first group of said plural openings being positioned to direct air from the interior of said stiffener to the exterior thereof in a direction forward and outward from said first surface, and a second group of said plural openings being positioned to direct air from the interior of said stiffener to the exterior thereof in a direction forward and outward from said second surface.

5. A nozzle for feeding a flowable combustion medium into a furnace having a combustion chamber, the nozzle comprising:

a nozzle tip for directing flow of said combustion medium into said combustion chamber, said nozzle tip including a shell having an inlet for receiving said combustion medium, an outlet for directing said combustion medium into said combustion chamber, and an interior space located between said inlet and said outlet;

a splitter located within said shell, the splitter comprising a plurality of splitter plates, each extending in a forward direction away from said inlet and toward said outlet, and dividing said interior space of said shell into plural channels, each channel allowing for the flow of part of said combustion medium from said inlet to said outlet;

wherein each of said splitter plates has a planar first surface, an opposite planar second surface, and a downstream edge extending across said shell adjacent the inlet thereof; and wherein said nozzle further comprises a stiffener extending along said downstream edge of each of said splitter plates, the external cross-section of each said stiffener, transverse to the direction in which the stiffener extends along said downstream edge, being in the form of a continuous curve proceeding outward and forward from said first surface to a first location, inward from said first location to a second location beyond the level of said second surface, and inward and rearward from said second location to said second surface;

whereby the downstream edge of each said splitter plate is stiffened, but recirculation of said combustion medium flowing past the stiffener thereon is minimized.

6. The nozzle according to claim 5, in which the external cross-section of each said stiffener has a cylindrical shape.

7. The nozzle according to claim 5, in which at least the part of the external cross-section of said stiffener that proceeds from said first location to said second location is convex.

8. The nozzle according to claim 5, in which each said stiffener has a hollow interior, an opening at least at one of its ends for receiving air from a channel in said nozzle tip, and plural openings distributed along its length, said plural openings extending from said hollow interior to the exterior thereof, a first group of said plural openings being positioned to direct air from the interior of the stiffener to the exterior thereof in a direction forward and outward from said first surface, and a second group of said plural openings being positioned to direct air from the interior of said stiffener to the exterior thereof in a direction forward and outward from said second surface.

* * * * *